US010928114B2

(12) United States Patent
An et al.

(10) Patent No.: US 10,928,114 B2
(45) Date of Patent: Feb. 23, 2021

(54) ICE MAKER, REFRIGERATOR HAVING THE SAME, AND METHOD FOR MAKING ICE

(71) Applicant: Samsung Electronics Co., Ltd, Gyeonggi-do (KR)

(72) Inventors: Hye-kyoung An, Suwon-si (KR); Kwan-yeol Lee, Hwaseong-si (KR); Jae-koog An, Gwangju (KR); Ho-cheol Cho, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 96 days.

(21) Appl. No.: 15/861,391

(22) Filed: Jan. 3, 2018

(65) Prior Publication Data

US 2018/0187941 A1 Jul. 5, 2018

(30) Foreign Application Priority Data

Jan. 3, 2017 (KR) ..... 10-2017-0000883

(51) Int. Cl.
*F25C 5/08* (2006.01)
*F25C 1/18* (2006.01)

(52) U.S. Cl.
CPC ..... *F25C 5/08* (2013.01); *F25C 1/18* (2013.01); *F25C 2400/06* (2013.01)

(58) Field of Classification Search
CPC ..... F25C 5/08; F25C 1/18; F25C 2400/06
USPC ..... 62/73
See application file for complete search history.

(56) References Cited

U.S. PATENT DOCUMENTS

| | | | | | |
|---|---|---|---|---|---|
| 3,188,827 | A * | 6/1965 | Bauerlein | F25C 1/04 | 62/137 |
| 6,145,320 | A * | 11/2000 | Kim | F25B 9/145 | 62/346 |
| 7,845,180 | B2 * | 12/2010 | Sugaya | F25C 5/06 | 62/137 |
| 2007/0089441 | A1 * | 4/2007 | Ito | F25C 1/22 | 62/135 |
| 2009/0165467 | A1 | 7/2009 | Kim et al. | | |
| 2009/0223230 | A1 * | 9/2009 | Kim | F25C 1/08 | 62/73 |

FOREIGN PATENT DOCUMENTS

| | | | | |
|---|---|---|---|---|
| JP | 2013204882 | A | 10/2013 | |
| JP | 5462045 | B2 | 4/2014 | |
| KR | 101324167 | B1 | 11/2013 | |
| KR | 101482097 | B1 | 1/2015 | |
| WO | WO-2011033804 | A1 * | 3/2011 | F25C 1/04 |

* cited by examiner

*Primary Examiner* — Steve S Tanenbaum

(57) ABSTRACT

An ice maker provided in a refrigerator is provided. The ice maker includes: first and second ice making units configured to include ice making trays, heaters heating the ice making trays for deicing, and ejectors ejecting made ice from the ice making trays, respectively, wherein a plurality of first ice making grooves are formed in the ice making tray of the first ice making unit, and a plurality of second ice making grooves are formed in the ice making tray of the second ice making unit, the plurality of second ice making grooves having a shape different from that of the plurality of first ice making grooves.

4 Claims, 8 Drawing Sheets

ICE MAKER, REFRIGERATOR HAVING THE SAME, AND METHOD FOR MAKING ICE

CROSS-REFERENCE TO RELATED APPLICATIONS

This application is related to and claims priority to Korean Patent Application No. 10-2017-0000883 filed on Jan. 3, 2017, the disclosure of which is incorporated herein by reference in its entirety.

TECHNICAL FIELD

Apparatuses and methods consistent with the present disclosure relate to an ice maker, a refrigerator having the same, and a method for making ice, and more particularly, to an ice maker capable of providing ice that is transparent and has various shapes, a refrigerator having the same, and a method for making ice.

BACKGROUND

A refrigerator is an apparatus supplying cold air generated by a cooling cycle to a storage room to maintain freshness of various foods for a long period of time. The refrigerator includes the storage room formed to store the various foods in an optimal state for a long period of time, and the storage room includes a refrigerator compartment and a freezer compartment compartmented from each other. The storage room is provided with an ice maker automatically making ice so that the ice may be conveniently provided to a user.

As the ice maker, there are an indirect cooling type ice maker making ice using cold air circulated in a freezer compartment and a direct cooling type ice maker making ice using a refrigerant pipe of a cooling cycle.

The ice maker provided in the refrigerator may generally make ice having a single shape. Therefore, ice having various shapes may not be provided to the user through the ice maker provided in the refrigerator.

In addition, the ice made by the ice maker is generally made in a state in which an inner portion of the ice is white and opaque. The reason is that air dissolved in water is pushed out to become air bubbles in a process in which the water is frozen and these air bubbles are blocked in all directions by the surrounding ice, such that they do not exit from the ice and are trapped in the ice. The opaque ice made as described above does not look good, and is dissolved at a speed faster than that of ice of which an inner portion is transparent.

SUMMARY

To address the above-discussed deficiencies, it is a primary object to provide an ice maker capable of providing ice having various shapes by including a plurality of ice making units making ice having different shapes, and a refrigerator having the same.

The present disclosure also provides a method for making ice capable of providing transparent ice using an existing deicing heater provided to make the transparent ice.

According to an aspect of the present disclosure, an ice maker provided in a refrigerator includes: first and second ice making units configured to include ice making trays, heaters heating the ice making trays for deicing, and ejectors ejecting made ice from the ice making trays, respectively, wherein a plurality of first ice making grooves are formed in the ice making tray of the first ice making unit, and a plurality of second ice making grooves are formed in the ice making tray of the second ice making unit, the plurality of second ice making grooves having a shape different from that of the plurality of first ice making grooves.

The heaters of the first and second ice making units may heat the ice making trays once or more, respectively, to delay a cooling speed of ice making water contained in the respective ice making trays before heating the ice making trays for the deicing.

The heaters of the first and second ice making units may be driven in different times.

A size of the plurality of first ice making grooves may be different from that of the plurality of second ice making grooves.

A number of first ice making grooves may be different from that of second ice making grooves.

According to another aspect of the present disclosure, a refrigerator includes: a body configured to have a freezer compartment; and a plurality of ice making units configured to be installed in the freezer compartment, wherein each of the plurality of ice making units includes: an ice making tray in which ice making water is contained; an ejector rotatably disposed above the ice making tray; and a heater disposed below the ice making tray for deicing, the heater heating the ice making tray once or more to delay a cooling speed of the ice making water in an ice making section.

Ice making grooves having different shapes may be formed in the ice making trays of the plurality of ice making units, respectively.

The refrigerator may further include a controller configured to drive the heaters of the plurality of ice making units in different times in the ice making section.

The controller may sequentially drive the heaters of the plurality of ice making units in the ice making section.

According to still another aspect of the present disclosure, a method for making ice using an ice maker provided in a refrigerator includes: supplying ice making water to a plurality of ice making trays; primarily heating the respective ice making trays to delay a cooling speed of the ice making water; secondarily heating the plurality of ice making trays by driving a plurality of heaters for deicing; and ejecting made ice from the respective ice making trays, wherein in the primary heating, the respective heaters are driven in different times.

In the primary heating, the respective heaters may be driven once or more.

In the primary heating, the respective heaters may be sequentially driven.

In the primary heating, the ice making trays may be maintained at a temperature higher than a freezing temperature for a predetermined time by the heaters.

BRIEF DESCRIPTION OF THE DRAWING

For a more complete understanding of the present disclosure and its advantages, reference is now made to the following description taken in conjunction with the accompanying drawings, in which like reference numerals represent like parts.

DETAILED DESCRIPTION

FIGS. 1 through 8, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Exemplary embodiments described below are illustratively provided to assist in understanding of the present disclosure, and it is to be understood that the present disclosure may be variously modified and executed unlike exemplary embodiments described herein. However, when it is decided that a detailed description for the known functions or components related to the present disclosure may obscure the gist of the present disclosure, the detailed description and concrete illustration will be omitted. Further, the accompanying drawings are not illustrated to scale, but sizes of some of components may be exaggerated to assist in the understanding of the present disclosure.

Hereinafter, an ice maker 100 will be described in detail after a refrigerator 1 according to an exemplary embodiment of the present disclosure is schematically described with reference to FIG. 1.

Figure 1:
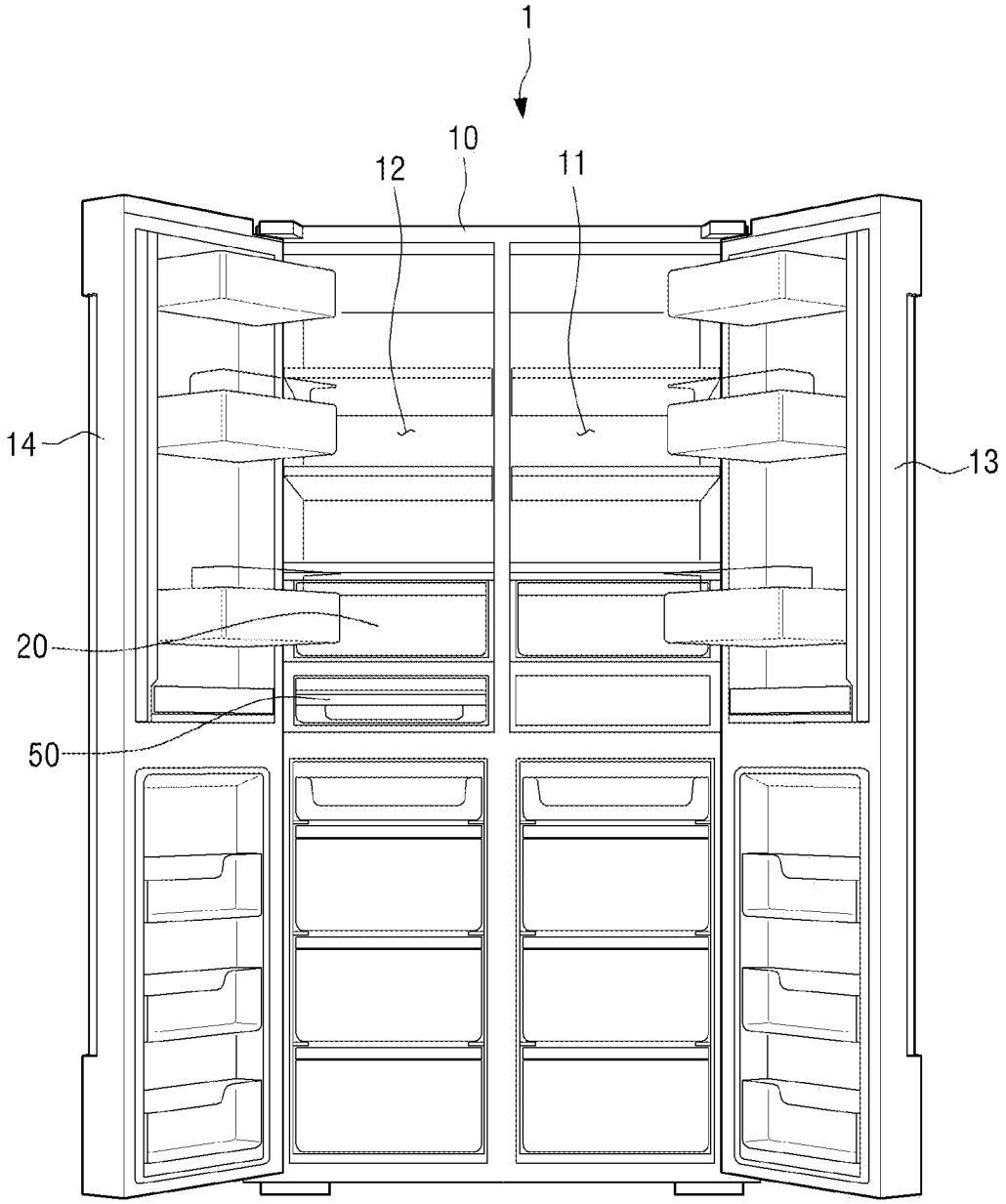
FIG. 1 is a perspective view schematically illustrating an inner portion of a freezer compartment of a refrigerator according to an exemplary embodiment of the present disclosure.

FIG. 1 is a perspective view schematically illustrating an inner portion of a freezer compartment of a refrigerator according to an exemplary embodiment of the present disclosure.

Referring to FIG. 1, the refrigerator 1 according to an exemplary embodiment of the present disclosure includes a body 10 and a storage room that may store foods in a refrigerated or frozen state. The storage room may be divided into a refrigerator compartment 11 in which foods are coldly stored in a temperature above zero and a freezer compartment 12 in which various foods are stored at a temperature below zero.

An ice maker 20 making ice is formed in the freezer compartment 12 of the refrigerator 1. Although a case in which the ice maker 20 is disposed in the freezer compartment 12 is illustrated in FIG. 1, the ice maker 20 is not limited thereto, but may be disposed in the refrigerator compartment 11 or be disposed in each of the refrigerator compartment 11 and the freezer compartment 12.

The ice maker 20 making the ice and an ice storing box 50 in which the ice made in the ice maker 20 is accumulated and stored are formed in the freezer compartment 12. The ice storing box 50 provides a space in which the ice separated from the ice maker 20 is accommodated. The ice storing box 50 is disposed below the ice maker 20 to correct the ice dropped from the ice maker 20.

An operation of the ice maker 20 will be briefly described. After water is supplied to the ice maker 20, cold air is supplied to the ice maker 20. The ice is made in the ice maker 20 by the supplied cold air, and the made ice is separated from the ice maker 20, and is dropped to and accommodated in the ice storing box 50. A user may use the ice accommodated in the ice storing box 50 by a desired amount whenever necessary.

Although not illustrated in FIG. 1, the refrigerator 1 is provided with components such as a compressor, a condenser, an inflator, an evaporator, and the like, for configuring a freezing cycle.

In addition, the refrigerator compartment 11 and the freezer compartment 12 are opened or closed by a refrigerator compartment door 13 and a freezer compartment door 14, respectively.

Figure 2:
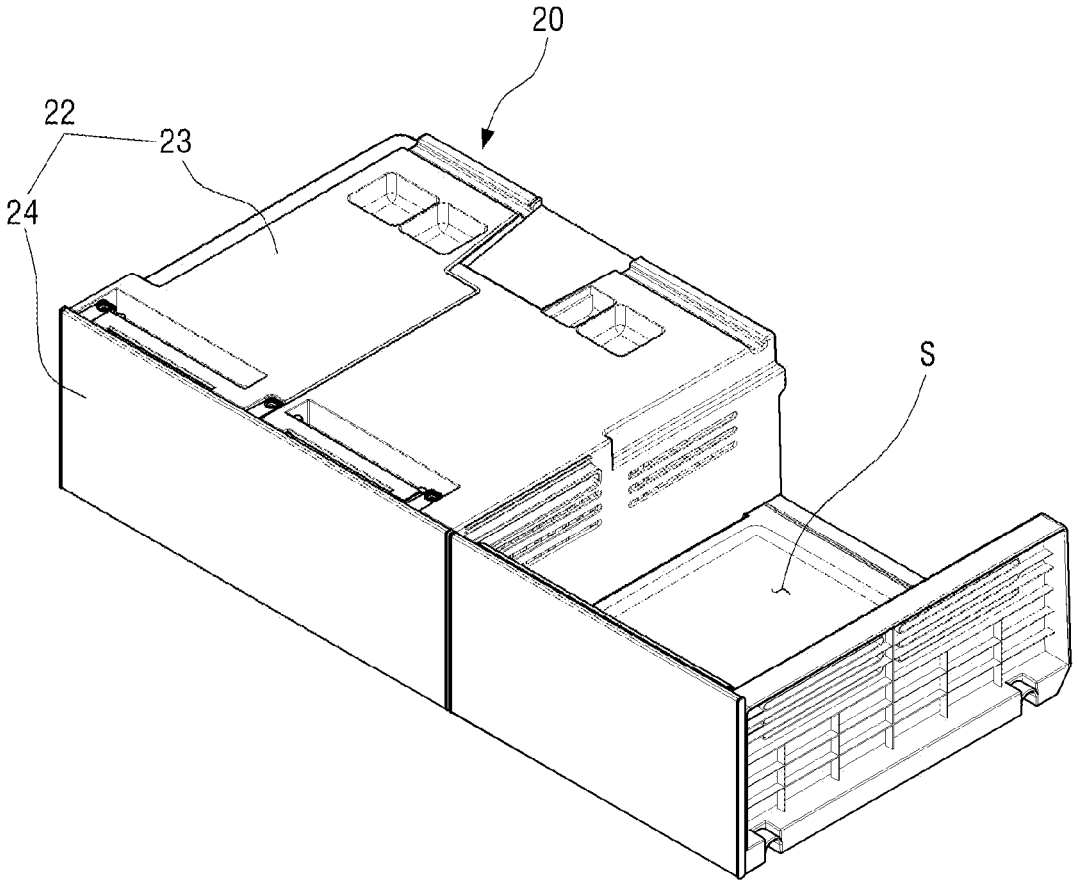
FIG. 2 is a perspective view illustrating an ice maker according to an exemplary embodiment of the present disclosure.
Figure 3:
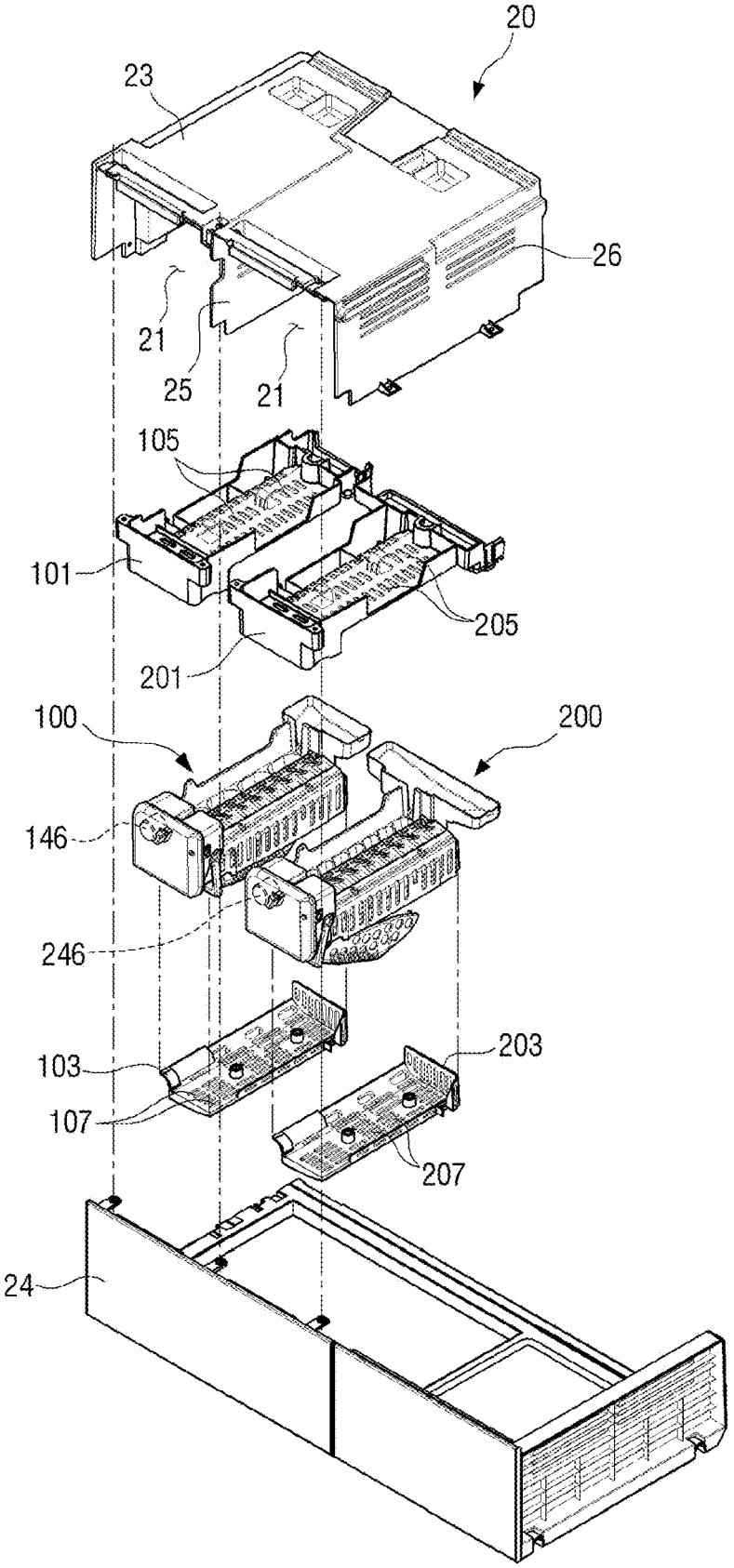
FIG. 3 is an exploded perspective view illustrating the ice maker according to an exemplary embodiment of the present disclosure.

FIGS. 2 and 3 are, respectively, a perspective view and an exploded perspective view illustrating the ice maker according to an exemplary embodiment of the present disclosure.

Referring to FIG. 2, the ice maker 20 is disposed to be compartmented from a storing space S of the freezer compartment. The ice maker 20 includes ice making rooms 21 in which first and second ice making units 100 and 200 may be accommodated, as illustrated in FIG. 3. The ice making rooms 21 are divided from the storing space S in which foods are stored by a housing 22.

The ice making rooms 21 are formed by a first housing 23 and a second housing 24. A partition wall 25 (see FIG. 3) partitioning a space in the ice making rooms 21 is formed in the ice making rooms 21. The first and second ice making units 100 and 200 are disposed in spaces separated from each other by the partition wall 25.

Referring to FIG. 3, the ice maker 20 includes the first ice making unit 100 and the second ice making unit 200. Although a case in which the ice maker 20 includes two ice making units 100 and 200 is illustrated in FIG. 3, the ice maker 20 is not limited thereto, but may include two or more ice making units when sizes or the number of ice making rooms 21 of the ice maker 20 are increased.

The first and second ice making units 100 and 200 are disposed in the respective ice making rooms 21 formed by the first and second housings 23 and 24.

In the ice maker 20, discharge holes 26 of the first housing 23 are formed at a minimum, and the partition wall 25 is formed in the first housing 23, such that the first ice making unit 100 and the second ice making unit 200 may be disposed independently from each other. An amount of air flowing in the ice making rooms 21 may be decreased by such a structure. Therefore, dissolved oxygen included in ice making water may smoothly exit from the ice making water. Therefore, ice made by the ice maker may be transparently made.

The first and second ice making units 100 and 200 may further include first ducts 101 and 201 and second ducts 103 and 203, respectively. Since the first and second ducts 101 and 103 of the first ice making unit 100 have the same structures as those of the first and second ducts 201 and 203 of the second ice making unit 200, only the first and second ducts 101 and 103 of the first ice making unit 100 will hereinafter be described.

The first duct 101 may be provided above the first ice making unit 100. An upper end of the first duct 101 may be coupled to the first housing 23 by a screwing structure. A lower end of the first duct 101 may be coupled to the first ice making unit 100. Therefore, the first duct 101 fixes the first ice making unit 100 so that the first ice making unit 100 is supported into the housing 22 (see FIG. 2).

The second duct 103 may be provided below the first ice making unit 100. The second duct 103 may drain water dropped from the first ice making unit 100 to the outside. An upper end of the second duct 103 may be coupled to the first ice making unit 100.

A temperature of the first ice making unit 100 becomes high by a heater 130 (see FIG. 5) included in the first ice making unit 100. The first ice making unit having the high temperature may be disposed to be spaced apart from inner surfaces of the housing 22 by predetermined intervals by the first and second ducts 101 and 103. The first and second ducts 101 and 103 include, respectively, a plurality of holes 105 and 107 formed to radiate heat of the first ice making unit 100.

Reference numerals 205 and 207 that are not described in FIG. 3 indicate holes for radiating heat.

Hereinafter, the first ice making unit 100 and the second ice making unit 200 will be described in detail.

Figure 4:
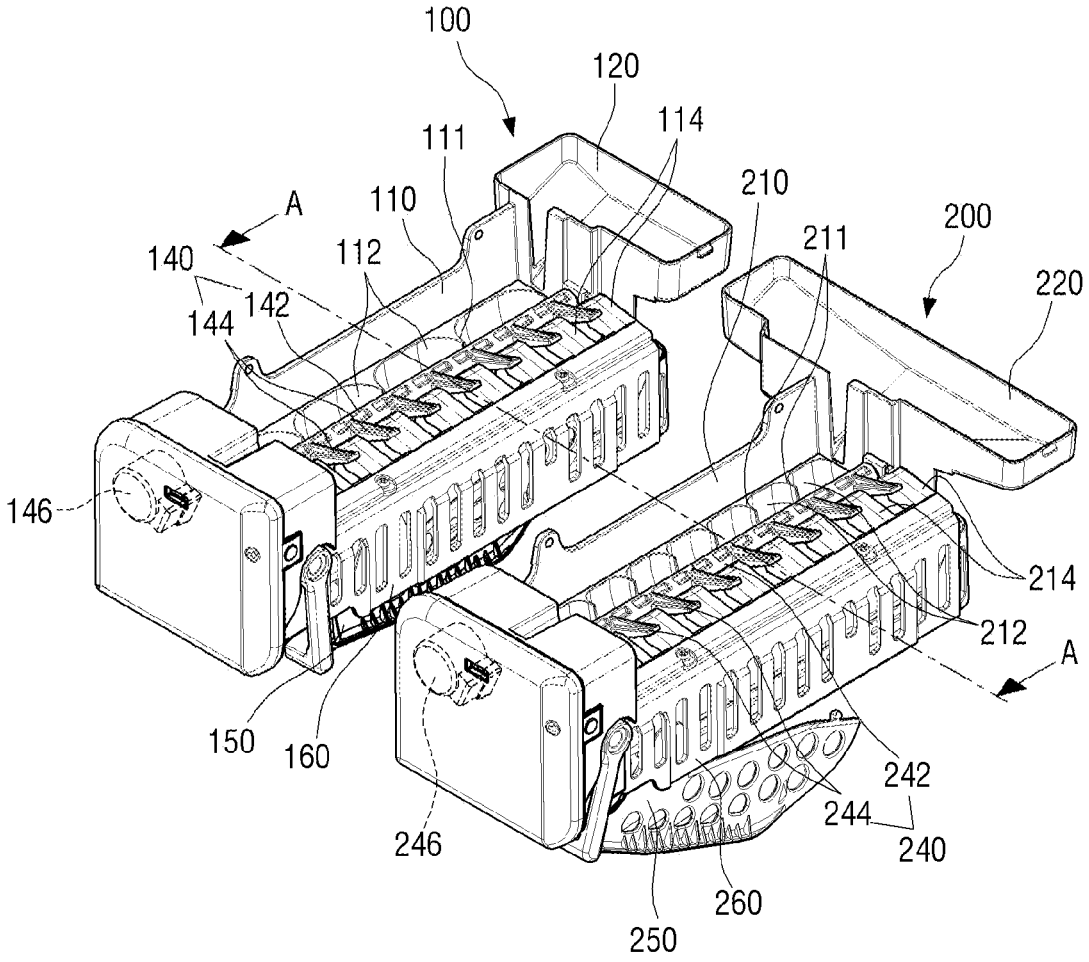
FIG. 4 is a perspective view illustrating first and second ice making units of the ice maker according to an exemplary embodiment of the present disclosure.
Figure 5:
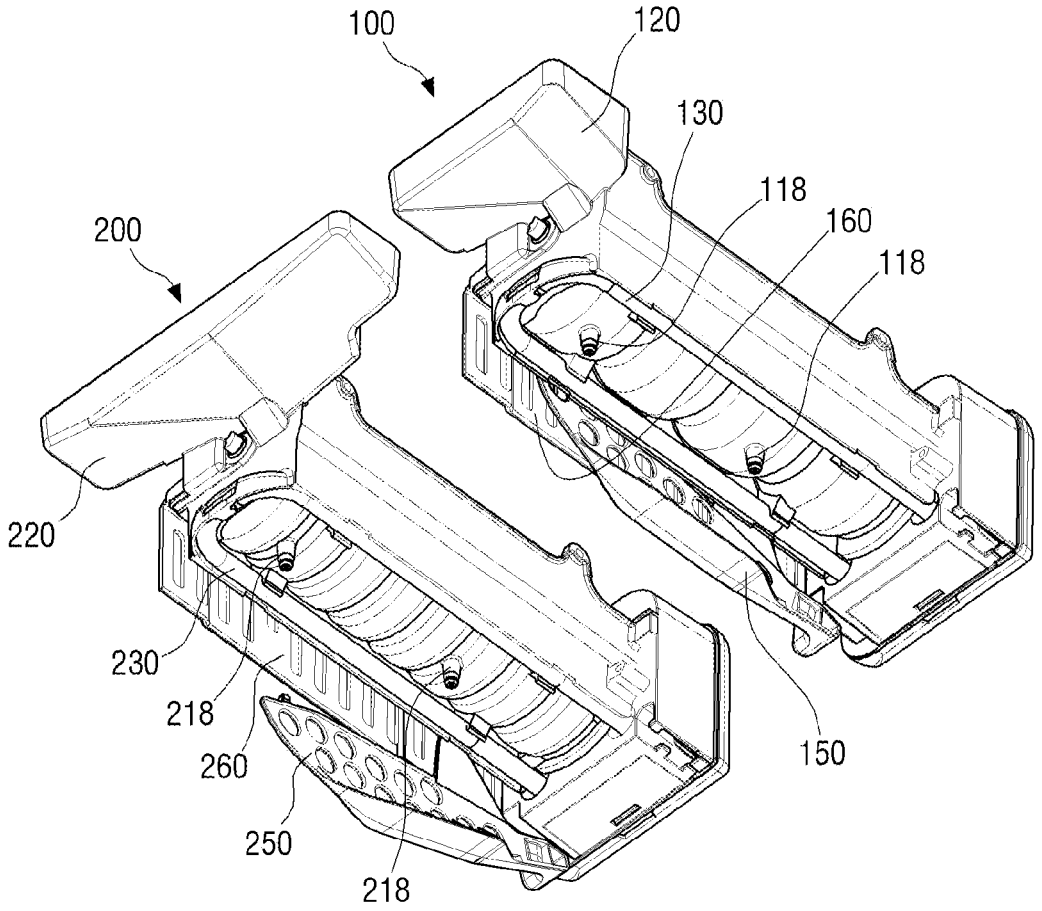
FIG. 5 is a bottom view of the first and second ice making units illustrated in FIG. 4.

FIG. 4 is a perspective view illustrating first and second ice making units of the ice maker according to an exemplary embodiment of the present disclosure, and FIG. 5 is a bottom view of the first and second ice making units illustrated in FIG. 4.

Referring to FIGS. 4 and 5, the first and second ice making units 100 and 200 include ice making trays 110 and 210 in which water to be ice-made is contained, water suppliers 120 and 220 supplying the water to the ice making trays 110 and 210, heaters 130 and 230 heating the ice making trays 110 and 210 to separate the ice made by the ice making trays 110 and 210, and ejectors 140 and 240 ejecting the made ice from the ice making trays 110 and 210, respectively.

Hereinafter, the first ice making unit 100 will be first described, and the second ice making unit 200 will then be described.

The ice making tray 110 of the first ice making unit 100 makes the ice by cold air in the freezer compartment 12. The ice making tray 110 has a plurality of first ice making grooves 112 having opened upper sides and partitioned by partition ribs 111. Sliders 114 guiding the ice separated from the ice making tray 110 by the ejector 140 to the ice storing box 50 are installed at one side of each first ice making groove 112, and the heater 130 heating the ice making tray 110 so that the ice may be separated from the ice making tray 110 at the time of deicing is installed on a lower surface of the ice making tray 110.

The first ice making grooves 112 are concavely formed to accommodate ice making water therein. The plurality of first ice making grooves 112 formed in the ice making tray 110 of the first ice making unit 100 have a shape different from that of second ice making grooves 212 of the second ice making unit 200 to be described below.

The ice making tray 110 may be formed of a material having excellent thermal conductivity, such as aluminum, copper, or the like.

The water supplier 120 supplies the water from an external water source to the ice making tray 110. The water supplier 120 is formed at one end of the ice making tray 110 in a length direction of the ice making tray 110 to supply the water to the ice making grooves 112. The water supplier 120 is formed to be inclined, and the water supplied through the water supplier 120 is sequentially supplied from an ice making groove 112 closest to the water supplier 120 to an ice making groove 112 most distant from the water supplier 120.

The ice making tray 110 includes excessively supplied water outlets 118 draining excessively supplied water to the second duct 103 in the case in which the water excessive in making the ice is supplied to the ice making grooves 112. The excessively supplied water outlets 118 are formed in a lower surface of the ice making tray 110.

The heater 130 is installed in an approximately U shape beneath the ice making tray 110, and applies a small amount of heat to the ice making tray 110 so that completed ice is separated from the ice making tray 110. In detail, the heater 130 heats the ice making tray 110 in a deicing section to melt a portion of the ice, thereby separating an inner surface of the ice making tray 110 and the ice from each other. The ice may be smoothly spaced apart from the ice making tray 110 by the heater 130. The deicing section means a time in which the completed ice is separated from the ice making tray 110 after the ice is completed in the ice making tray 110.

Particularly, the heater 130 of the ice maker 20 according to an exemplary embodiment of the present disclosure is driven in an ice making section as well as the deicing section. The heater 130 of the first ice making units 100 heats the ice making tray 110 once or more to delay a cooling speed of the ice making water W contained in the ice making tray 110 before heating the ice making tray 110 for dicing.

The ice making section means a time in which the water supplied into the ice making tray 110 by a predetermined amount is ice-made using the cold air discharged into the ice making rooms 21. In the ice making section, the heater 130 is driven to heat the ice making tray 110 once or more. In the ice making section, the ice making tray 110 may be heated to delay a time in which a surface of the ice of the ice making tray 110 is frozen. Therefore, when the cooling speed of the ice making water is delayed, the dissolved oxygen included in the ice making water smoothly exits from the ice making water, such that the ice making unit 100 may make transparent ice.

Since the ice maker according to an exemplary embodiment of the present disclosure uses the heater 130 installed for deicing without adding a separate heater to the ice making tray 110 to made the transparent ice, a cost required for adding the separate heater may be saved, and the ice maker may be easily applied to an existing refrigerator.

The ejector 140 is installed above the ice making tray 110, and separates the ice made in the ice making tray 110 from the ice making tray 110. The ejector 140 includes an ejector shaft 142 rotatably installed above the ice making tray 110 in the length direction of the ice making tray 110 and a plurality of ejector arms 144 extended from the ejector shaft 142 in a radial direction at positions corresponding to the respective ice making grooves 112 of the ice making tray 110.

The ejector shaft 142 rotates by a motor 146 connected to one end of the ejector shaft 142. Therefore, when the ejector shaft 142 rotates, the ejector arms 144 push the ice in the respective ice making grooves 112. Therefore, the ice is separated from the ice making tray 110.

The first ice making unit 100 may further include a full ice sensing lever 150 deciding whether or not the ice is filled in the ice storing box 50 by a set amount. The full ice sensing lever 150 is installed at one side of the ice making tray 110 so that one end thereof is rotatable. The ice maker 20 may stop to make the ice when the ice is fully filled in the ice storing box 50, by the full ice sensing lever 150.

A guide cover 160 covering a side surface of the full ice sensing lever 150 is installed to prevent the ice separated from the ice making tray 110 from hindering movement of the full ice sensing lever 150. The guide cover 160 is extended from one side of the ice making tray 110, and the ice separated from the ice making tray 110 is guided to the ice storing box 50 by the guide cover 160. The full ice sensing lever 150 may be installed between a side surface of the ice making tray 110 and the guide cover 160. The separated ice does not hinder rotation of the full ice sensing lever 150 by the guide cover 160.

Hereinafter, the second ice making unit 200 will be described. A description for portions that are the same as those of the first ice making unit 100 described above will be omitted.

The second ice making unit 200 includes the ice making tray 210, the water supplier 220, the heater 230, the ejector 240, a full ice sensing lever 250, and a guide cover 260, as in the first ice making unit 100. The second ice making unit 200 has the ice making tray 210 different from the ice making tray 110 of the first ice making unit 110.

The ice making tray 210 of the second ice making unit 200 has a plurality of second ice making grooves 212 having opened upper sides and partitioned by partition ribs 211. Sliders 214 guiding the ice separated from the ice making tray 210 by the ejector 240 to the ice storing box 50 are installed at one side of each second ice making groove 212, and the heater 230 heating the ice making tray 210 so that the ice may be separated from the ice making tray 210 at the time of deicing is installed on a lower surface of the ice making tray 210.

The plurality of second ice making grooves 212 have a shape different from that of the plurality of first ice making grooves 112 of the first ice making unit 100. The second ice making grooves 212 have a size different from that of the first ice making grooves 112, and the number of second ice making grooves 212 is different from that of first ice making grooves 112. In detail, the first ice making grooves 112 are formed at a size greater than that of the second ice making grooves 1212, and the number of first ice making grooves 112 is smaller than that of the second ice making grooves 212.

The first ice making unit 100 and the second ice making unit 200 include the ice making trays 110 and 210 having the first and second ice making grooves 112 and 212 having different shapes, respectively. Therefore, the first ice making unit 100 and the second ice making unit 200 may make ice having different shapes, and make ice having different sizes. Although not illustrated, the ice may have several shapes such as a semi-lunar shape, a polygonal shape, a circular shape, a stellar shape, and the like. Therefore, the ice maker 20 makes the ice having the different shapes to allow a user to select the ice according to his/her preference.

The heater 230 of the second ice making unit 200 is driven in the ice making section as well as the deicing section, as in the heater 130 of the first ice making unit 100. The heater 230 heats the ice making tray 210 once or more to delay a cooling speed of the ice making water W (see FIG. 6) contained in the ice making tray 210 before heating the ice making tray 210 for the deicing. Here, the heaters 130 and 230 of the first and second ice making units 100 and 200 are driven in different times. That is, when the heater 130 of the first ice making unit 100 is driven, the heater 230 of the second ice making unit 200 is not driven.

The ice maker 20 may further include a controller (not illustrated) driving the heaters 130 and 230 of a plurality of ice making units 100 and 200 in different times, respectively. The controller (not illustrated) may sequentially drive the heaters 130 and 230 of the plurality of ice making units 100 and 200 in the ice making section. The plurality of ice making units 100 and 200 do not simultaneously drive the heaters 130 and 230, but drive the heaters 130 and 230 at a predetermined time difference. Therefore, maximum power of the refrigerator 1 may be maintained to be equal to that of the case of using one ice making unit.

Reference numeral 246 that is not described in FIG. 4 indicates a motor, and reference numeral 218 that is not described in FIG. 5 indicates an excessively supplied water outlet.

Figure 6:
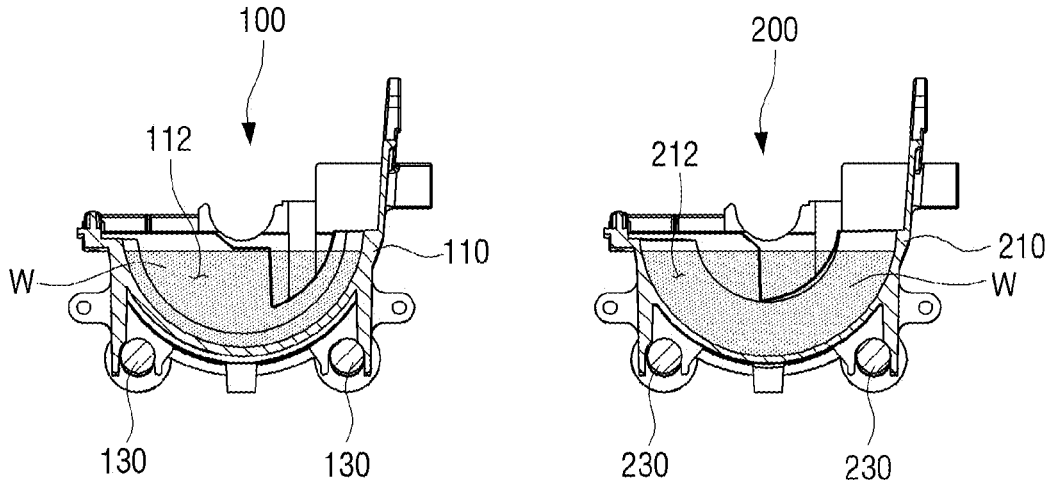
FIG. 6 is a cross-sectional view taken along line A-A illustrated in FIG. 4.

FIG. 6 is a cross-sectional view taken along line A-A illustrated in FIG. 4.

Referring to FIG. 6, in the plurality of ice making units 100 and 200 of the ice maker 20 according to an exemplary embodiment of the present disclosure, the respective heaters 130 and 230 are also driven in the ice making section.

The first ice making unit 100 and the second ice making unit 200 are the same as each other in that the ice making trays 110 and 210 make the transparent ice. Hereinafter, only the first ice making unit 100 will be described.

The heater 130 of the first ice making unit 100 heats the ice making tray 110 to make the ice. The heater 130 maintains the ice making tray 110 to be maintained at a temperature higher than a freezing temperature for a predetermined time. This is to prevent a phenomenon in which the water W supplied to the first ice making grooves 112 of the ice making tray 110 is rapidly frozen in a state in which air dissolved in the water is included in the water, such that opaque ice is made.

The ice making tray 110 is maintained at the temperature higher than the freezing temperature for the predetermined time by the heater 130 in the ice making section to delay a speed at which the ice is made. Therefore, gas dissolved in the water W supplied to the first ice making grooves 112 is discharged to the outside before the water is frozen, such that the first ice making unit 100 may make the transparent ice.

The heater 130 is driven to heat the ice making tray 110 once or more in the ice making section. When the heater 130 is operated, the temperature of the ice making tray 110 may be raised to delay a time in which a surface of the ice is frozen. A phase change time in which the water is turned into the ice may be increased to delay the cooling speed of the ice. Therefore, dissolved gas and detained air bubbles of the ice making water of the ice making tray 110 may be discharged to the outside of the ice.

Water molecules move while being scattered in a downward direction while ice crystallization being grown in a dendrite form from a bottom surface of the ice making tray 110, and dissolved air bubbles are pushed out toward upper water that is in a liquid state by a density difference. Therefore, when the cooling speed of the ice making water is delayed in the ice making section, the air bubbles of the ice making water may exit from the water for an increased phase change time, and the detained air bubbles may thus be removed.

Figure 7:
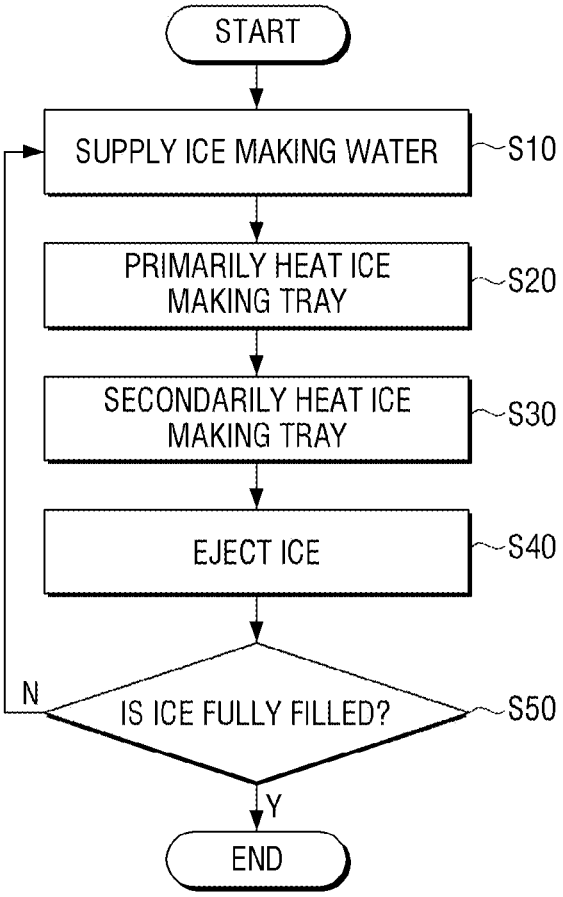
FIG. 7 is a flow chart illustrating a method for making ice according to an exemplary embodiment of the present disclosure.

FIG. 7 is a flow chart illustrating a method for making ice according to an exemplary embodiment of the present disclosure.

Hereinafter, a method for making ice using the refrigerator 1 according to the present disclosure will be described in detail.

When an ice making operation starts, a predetermined amount of water W is supplied to the first and second ice making grooves 112 and 212 of a plurality of ice making trays 110 and 210 (S10) (see FIG. 6).

The water contained in the first and second ice making grooves 112 and 212 is cooled by the cold air in the freezer compartment, and the heaters 130 and 230 mounted on lower surfaces of the ice making trays 110 and 210, respectively, are operated during the cooling process as described above (S20). The respective ice making trays 110 and 210 are primarily heated to delay the cooling speed of the ice making water W (S20). The heating for delaying the cooling speed of the ice making water is called primary heating. The primary heating is performed by the heaters 130 and 230 of the plurality of ice making units 100 and 200 in the ice making section. The primary heating as described above may be performed once or more at a predetermined interval.

Points in time at which the heaters 130 and 230 are operated may be determined by measuring a temperature of the water contained in the ice making grooves 112 and 212 or measuring a time elapsing after a process of cooling the water starts. When the respective heaters 130 and 230 are operated as described above, the cooling speed of the ice making water W may be delayed. The cooling speed of the ice making water W is delayed while the phase change time in which the water is turned into the ice being increased, such that the air bubbles generated in the water are discharged to the outside through a water surface that is not frozen. Therefore, the ice maker 20 may make the transparent ice.

In the primary heating (S20), the ice making trays 110 and 210 may be maintained at the temperature higher than the freezing temperature for the predetermine time by the driving of the heaters 130 and 230. Therefore, a speed at which the ice is made is delayed, and the gas dissolved in the water supplied to the ice making grooves 112 and 212 is discharged to the outside before the water is frozen, such that the ice making units 100 and 200 may make the transparent ice.

In addition, in the primary heating (S20), the respective heaters 130 and 230 of the plurality of ice making units 100 and 200 are driven in different times. The respective heaters 130 and 230 are driven at a predetermined time difference. Even though the ice maker 20 includes the plurality of ice making units 100 and 200, the respective heaters 130 and 230 are not simultaneously operated. Therefore, there is no difference in maximum power between the ice maker 20 and an ice maker including one ice making unit 100 or 200.

In the primary heating (S20), the respective heaters 130 and 230 may be driven once or more. The number of times by which the heaters 130 and 230 are operated may be determined by measuring a temperature of the water contained in the ice making grooves 112 and 212 or measuring a time elapsing after a process of cooling the water starts.

In the primary heating (S20), the cooling speed of the ice making water is delayed by the driving of the heaters 130 and 230, such that a time in which the air bubbles in the water are discharged to the outside is increased. In this process, the air bubbles B in the water are continuously discharged to the outside, such that the transparent ice may be made.

When the water finally remaining after the primary heating (S20) is completely frozen, such that the ice making is completed, a plurality of heaters 130 and 230 are operated for the deicing to heat the plurality of ice making trays 110 and 210 (S30). In this process, the heating for the deicing is called secondary heating (S30). The secondary heating is performed in the deicing section. The ice may become a state in which it may be easily separated from inner surfaces of the respective ice making grooves 112 and 212 depending on the secondary heating (S30).

Also in the secondary heating (S30), the respective heaters 130 and 230 of the plurality of ice making units 100 and 200 are driven in different times. The respective heaters 130 and 230 are driven at a predetermined time difference. That is, even though the ice maker 20 includes the plurality of ice making units 100 and 200, the respective heaters 130 and 230 are not simultaneously operated. Therefore, there is no difference in maximum power between the ice maker 20 and an ice maker including one ice making unit 100 or 200.

After the secondary heating, the made ice is ejected from the respective ice making trays 110 and 210 (S40). In detail, the ejector shafts 140 and 240 rotate, such that the ejector arms 144 and 244 push the ice. Therefore, the ice is separated from the ice making grooves 112 and 212, and then moves toward the ice storing box 50 (S40).

After the made ice is ejected (S40), it may be confirmed whether or not the ice is fully filled in the ice storing box 50 (S50). The full ice sensing levers 150 and 250 installed at one sides of the ice making trays 110 and 210 so that one ends thereof are rotatable rotate toward the ice storing box 50. It is decided whether or not the ice is fully filled in the ice storing box 50 through the rotation of the full ice sensing levers 150 and 250 (S50).

An ice making operation of the ice maker 20 may be stopped when the ice is fully filled in the ice storing box 50, by the full ice sensing levers 150 and 250.

When the ice is not fully filled in the ice storing box 50, the ice making water is again supplied to the plurality of ice making trays 110 and 210 (S10). The ice making operations described above are continuously performed repeatedly.

The primary heating (S20) and the secondary heating (S30) may be performed in different times in the plurality of ice making units 100 and 200. That is, the plurality of heaters 130 and 230 are driven at a predetermined time difference.

Figure 8:
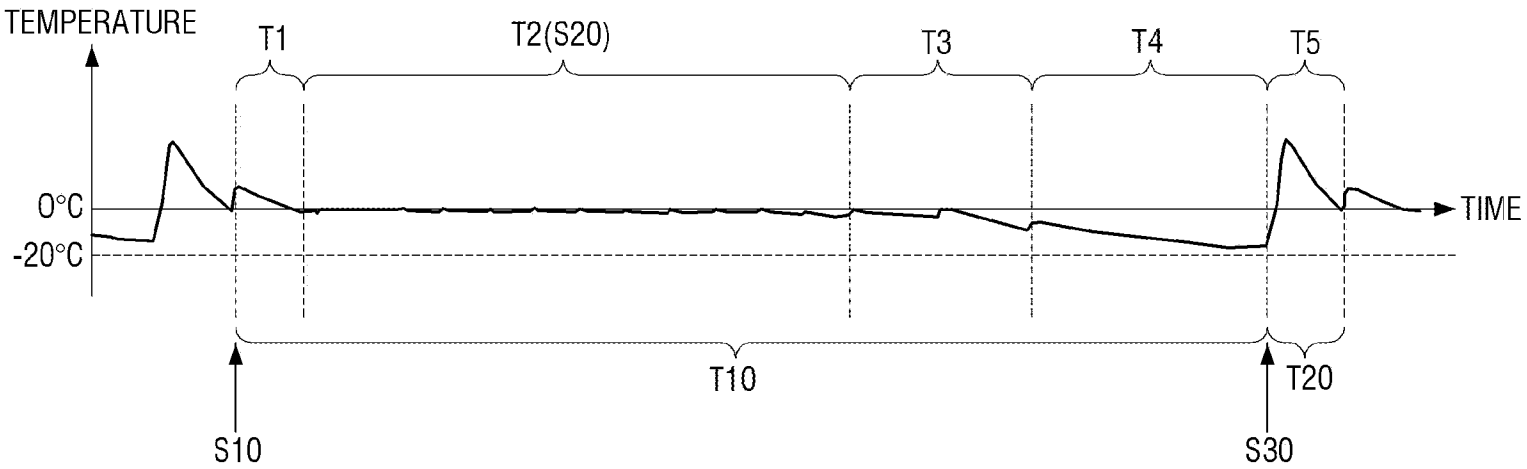
FIG. 8 is a view illustrating the method for making ice of FIG. 7 as a graph of a time and a temperature.

FIG. 8 is a view illustrating the method for making ice of FIG. 7 as a graph of a time and a temperature.

Referring to FIG. 8, this graph is a graph illustrating a temperature of the ice making trays 110 and 210 over time. The method for making ice by the ice maker 20 includes an ice making section T10 in which the ice is made in the ice making trays 110 and 210 and a deicing section T20 in which the completed ice is separated from the ice making trays 110 and 210.

When water in a room temperature state is supplied to the plurality of ice making trays 110 and 210 (S10) in the ice making section T10, the temperature of the ice making trays 110 and 210 rises. When a predetermined time T1 elapses after the water is supplied, the primary heating (S20) starts. The time T1 in which the primary heating (S20) starts after the water is supplied (S10) is a point in time at which a temperature of the supplied water in the room temperature state becomes 0° C. T1 may be about 15 minutes to 20 minutes as an experiment result.

The primary heating (S20) may be performed for a time T2. The plurality of heaters 130 and 230 are operated once or more for the time T2 to heat the ice making trays 110 and 210, respectively. T2 is preferably 3 hours, and the heaters 130 and 230 may heat the ice making trays 110 and 210, respectively, for 10 seconds at an interval of 15 minutes in the time T2. Therefore, the ice making trays 110 and 210 is maintained at a temperature of 0° C. to −4° C. The ice making water W is not rapidly cooled, but is cooled at the temperature of 0° C. to −4° C. for a predetermined time. Therefore, the air dissolved in the supplied water W is discharged to the outside, such that the transparent ice may be made. Here, the respective heaters 130 and 230 of the plurality of ice making units 100 and 200 are driven in different times.

The primary heating (S20) may be additionally performed to make more transparent ice. The primary heating (S20) may be additionally performed for a time T3 in addition to the time T2.

After the primary heating (S20), the ice is cooled for a predetermined time T4 until the ice is completed. Separate heating is not performed for the time T4.

When the ice is completed, the ice making section T10 ends, and the deicing section T20 in which the ice is separated from the ice making trays 110 and 210 starts. In the deicing section T20, the heater 130 and 230 heat the ice making trays 110 and 210, respectively, for the deicing (S30). The ice separated from the ice making trays 110 and 210 in the secondary heating (S30) is stored in the ice storing box 50. The ice making processes as described above are repeated until the ice is fully filled in the ice storing box 50.

Hereinabove, the present disclosure has been described as an illustrative method. It is to be understood that terms used herein are provided to describe the present disclosure rather than limiting the present disclosure. Various modifications and alternations of the present disclosure may be made according to the contents described above. Therefore, the present disclosure may be freely practiced without departing from the scope of the claims unless additionally mentioned.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A refrigerator comprising:

a body including a freezer compartment;

first and second ice making units installed in the freezer compartment; and a controller configured to control the first and second ice making units, wherein each of the first and second ice making units include:

an ice making tray configured to contain water, a heater disposed below the ice making tray, and an ejector rotatably disposed above the ice making tray, and wherein the controller is configured to:

control each of the heaters of the first and second ice making units to heat each of the ice making trays to delay a cooling speed of the water in the ice making trays in an ice making process, control each of the heaters to heat the ice making trays in a deicing process, control the ejector to rotate, and in the ice making process, control each of the heaters to drive alternately such that one of the heaters does not drive while one of the heaters drives.

2. The refrigerator as claimed in claim 1, wherein each of the ice making trays of the first and second ice making units, respectively comprise ice making grooves having different shapes.

3. The refrigerator as claimed in claim 2, wherein a size of the ice making grooves in the first ice making unit is different from a size of the ice making grooves in the second ice making unit.

4. The refrigerator as claimed in claim 2, wherein a number of the ice making grooves in the first ice making unit is different from a number of the ice making grooves in the second ice making unit.

* * * * *